US007544283B2

(12) United States Patent
Daiku et al.

(10) Patent No.: US 7,544,283 B2
(45) Date of Patent: Jun. 9, 2009

(54) METHOD AND APPARATUS FOR REMOVING THIN METAL FILMS

(75) Inventors: Hiroyuki Daiku, Osaka (JP); Hidehiko Maehata, Osaka (JP); Masanori Tsukahara, Osaka (JP); Shogo Hamada, Osaka (JP); Tetsuya Inoue, Osaka (JP); Hiroshi Hamasaki, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 619 days.

(21) Appl. No.: 11/103,182

(22) Filed: Apr. 11, 2005

(65) Prior Publication Data

US 2005/0179023 A1 Aug. 18, 2005

Related U.S. Application Data

(63) Continuation of application No. PCT/JP03/12630, filed on Oct. 2, 2003.

(30) Foreign Application Priority Data

Oct. 11, 2002 (JP) ..... 2002-298947
Nov. 20, 2002 (JP) ..... 2002-336838

(51) Int. Cl.

| | |
|---|---|
| ***B23H 7/26*** | (2006.01) |
| ***C25F 3/14*** | (2006.01) |
| ***B23H 3/00*** | (2006.01) |
| ***C25B 15/00*** | (2006.01) |

(52) U.S. Cl. ..... 205/672; 205/133; 205/640; 205/668; 205/686; 204/194; 204/199

(58) Field of Classification Search ..... 205/133, 205/640, 668, 672, 686; 204/194, 198, 199, 204/212, 232

See application file for complete search history.

(56) References Cited

U.S. PATENT DOCUMENTS

| | | | | |
|---|---|---|---|---|
| 6,153,535 | A | 11/2000 | Takimoto | |
| 6,723,224 | B2 * | 4/2004 | Yahalom et al. | 205/668 |
| 2002/0011421 | A1 * | 1/2002 | Haba et al. | 205/667 |

FOREIGN PATENT DOCUMENTS

| | | | |
|---|---|---|---|
| JP | S51-050247 | A | 5/1976 |
| JP | S59-193859 | U | 12/1984 |
| JP | S62-290900 | A | 12/1987 |
| JP | H07-207500 | A | 8/1995 |

* cited by examiner

*Primary Examiner*—Harry D. Wilkins, III
*Assistant Examiner*—Zulmariam Mendez
(74) *Attorney, Agent, or Firm*—Brinks Hofer Gilson & Lione

(57) ABSTRACT

A system for removing a thin metal film is disclosed. The system comprises an inclined metal plate electrode for guiding a downward electrolyte flow, an auxiliary electrode placed on either the upstream or downstream side of the metal plate electrode such that a part of the auxiliary electrode is immersed into the electrolyte, and a power supply for applying a DC voltage to the both electrodes. The system is used to remove a metal thin film on the surface of an insulator by making the electrolyte flowing down the metal plate electrode strike against the metal thin film while the DC voltage is applied to the metal plate electrode and auxiliary electrode.

10 Claims, 10 Drawing Sheets

(a)

(b)

METHOD AND APPARATUS FOR REMOVING THIN METAL FILMS

This application is a Continuation of PCT/JP03/012630 filed Oct. 2, 2003, and claims priority under 35 U.S.C. § 119 to Japanese Patent Application Nos. 2002-298947 filed Oct. 11, 2002 and 2002-336838 filed Nov. 20, 2002, the entire contents of which are hereby incorporated by reference.

TECHNICAL FIELD

The present invention relates to a method for removing thin metal films from substrates in the case that the thin metal films formed by vapor deposition or metal plating do not satisfy quality control standards, for example, and an apparatus for implementing this method.

BACKGROUND

High-performance glass substrates that have superior optical performance (transmittivity, etc.) and mechanical performance (flatness, etc.) are used in flat panel displays, for example. However, they are expensive, so if the thin metal films formed upon their surfaces do not satisfy quality control standards, it is preferable to remove the thin metal films and reuse the substrates.

Methods of removing these thin metal films include the method of removal by chemical etching. As shown in FIG. 18, this method is one wherein a substrate 2 that has formed on its surface a thin metal film that is to be removed is immersed in a chemical solution 1 that can dissolve the thin metal film by a chemical reaction, thus removing the thin metal film (see the publications of unexamined Japanese patent application (Kokai) Nos. JP-A-H6-321581 and JP-A-H9-86968, for example).

However, the method of removal by chemical etching requires the use of strongly acidic or strongly alkaline chemical solutions, and thus has the following problems.

1) Great care must be taken in its handling, worsening the work productivity.
2) The apparatus must be made corrosion-resistant and is thus expensive.
3) The chemical solution is basically not reusable, giving large amounts of waste.
4) After use, disposal of the waste liquid from the chemical solution is difficult.

The present invention came about in consideration of the aforementioned problems with the prior art, and has as its object to provide a method that is able to efficiently remove thin metal films basically in a non-contact manner without the use of strongly acidic or strongly alkaline chemical solutions, and that does not require precise positional control, and an apparatus for implementing this method.

BRIEF SUMMARY—DISCLOSURE OF THE INVENTION

The first method for removing thin metal films according to the present invention is one that uses a first apparatus for removing thin metal films according to the present invention comprising: a metal-plate electrode disposed at an incline that guides the downstream flow of electrolyte, an auxiliary electrode disposed partially such that a portion thereof is immersed in the electrolyte on the upstream or downstream side of this metal-plate electrode, and a DC voltage supply that applies a DC voltage to the two electrodes, so that electrolyte that flows down upon the metal-plate electrodes in the state in which a DC voltage is applied to the metal-plate electrode and auxiliary electrode impinges upon the thin metal film on the insulator surface, thus removing the thin metal film.

Thus, with this first method according to the present invention, without using strongly acidic or strongly alkaline chemical solutions, and without requiring precision control of the position of a nozzle electrode with respect to a thin metal film on an insulator surface, the thin metal film can be removed efficiently in a non-contact manner without damaging the insulator.

In addition, the second method for removing thin metal films according to the present invention is one that uses a second apparatus for removing thin metal films according to the present invention, wherein a bottom-surface electrode is disposed below the metal-plate electrode and auxiliary electrode of the first apparatus for removing thin metal films according to the present invention so as to span across the two electrodes, and DC voltage of the same polarity as that of the auxiliary electrode is also applied to this bottom-surface electrode from the DC voltage supply. So in the second method for removing thin metal films according to the present invention, electrolyte that flows down upon the metal-plate electrodes in the state in which a DC voltage is also applied to the bottom-surface electrode disposed on the back side of the insulator impinges upon the thin metal film on the insulator surface, thus removing the thin metal film.

In this manner, the functions and meritorious effects of the first method according to the present invention are promoted even further.

In the first or second method according to the present invention, if a movement mechanism that moves at least one of the insulator and metal-plate electrode immersed in the electrolyte relative to the other is provided, and the thin metal film is removed while moving the insulator and metal-plate electrode relative to each other, then the thin metal film can be removed over a wide range.

In addition, the third method for removing thin metal films according to the present invention is one that uses a third apparatus for removing thin metal films according to the present invention, comprising that of either the first or second method according to the present invention, wherein a member that suppresses intrusion of electrolyte is provided on the admission side of the insulator in the metal-plate electrode, so as to suppress the early intrusion of electrolyte toward the side of the end of the insulator.

Doing so can prevent the occurrence of a pitted thin metal film.

In addition, the fourth method for removing thin metal films according to the present invention is one that uses a fourth apparatus for removing thin metal films according to the present invention, comprising that of any of the first through third methods according to the present invention, wherein the metal-plate electrode is made a rotatable electrode, abrasive material is disposed in the area where this electrode makes contact with the thin metal film, or means of supplying abrasive material to the area of contact between the electrode and the thin metal film is provided, and thus the abrasive material positioned in the area of contact between this electrode and the thin metal film abrades the surface of the thin metal film.

With this fourth method according to the present invention, any film remaining after electrolytic etching can be completely removed.

BRIEF DESCRIPTION OF THE DRAWINGS

FIG. 5(*b*) is a diagram of an insulator wherein a thin metal film remains in the terminal area;

DETAILED DESCRIPTION OF THE DRAWINGS AND THE PRESENTLY PREFERRED EMBODIMENTS

Here follows an even more detailed description of the present invention made with reference to the appended drawings.

Figure 1:
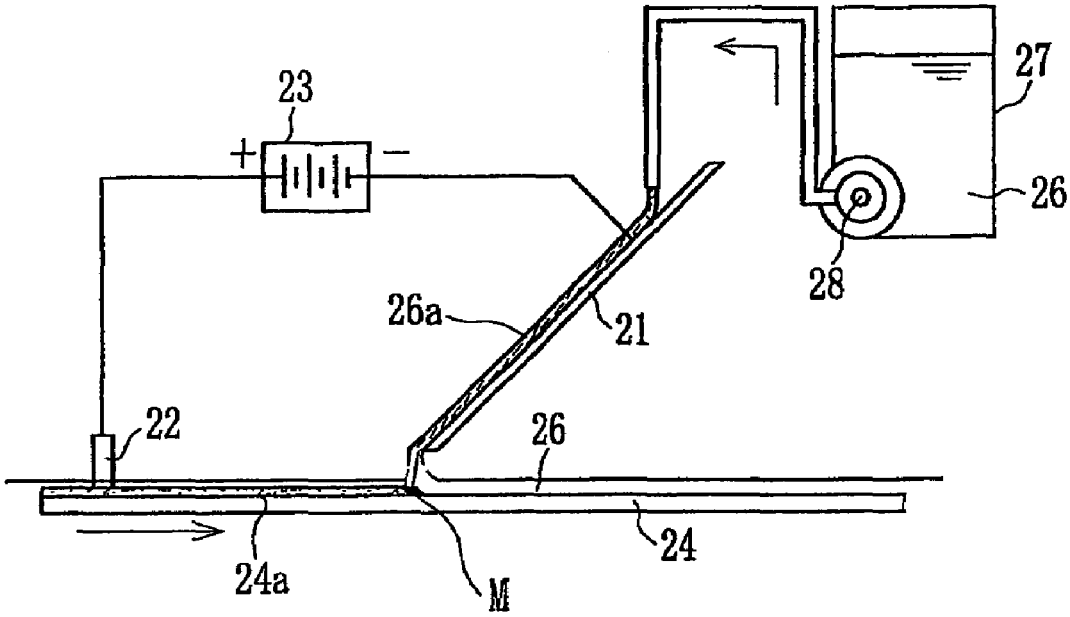
FIG. 1 is a schematic structural diagram illustrating one example of an apparatus for removing thin metal films as Embodiment 1 of the present invention.
Figure 2:
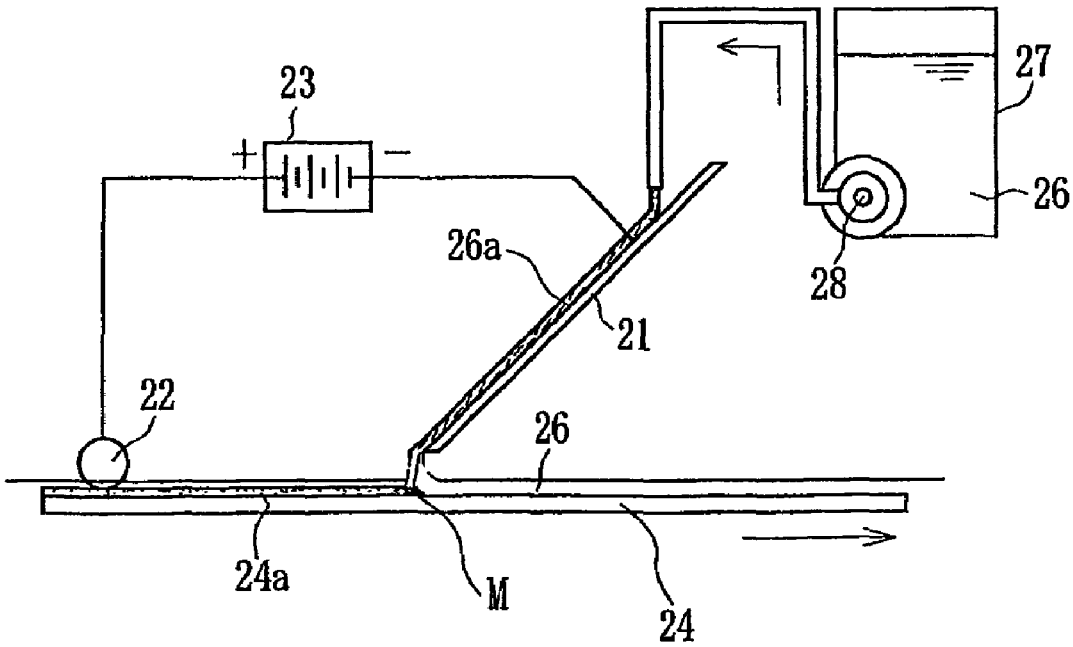
FIG. 2 is a schematic structural diagram illustrating a second example of an apparatus for removing thin metal films as Embodiment 1 of the present invention.
Figure 3:
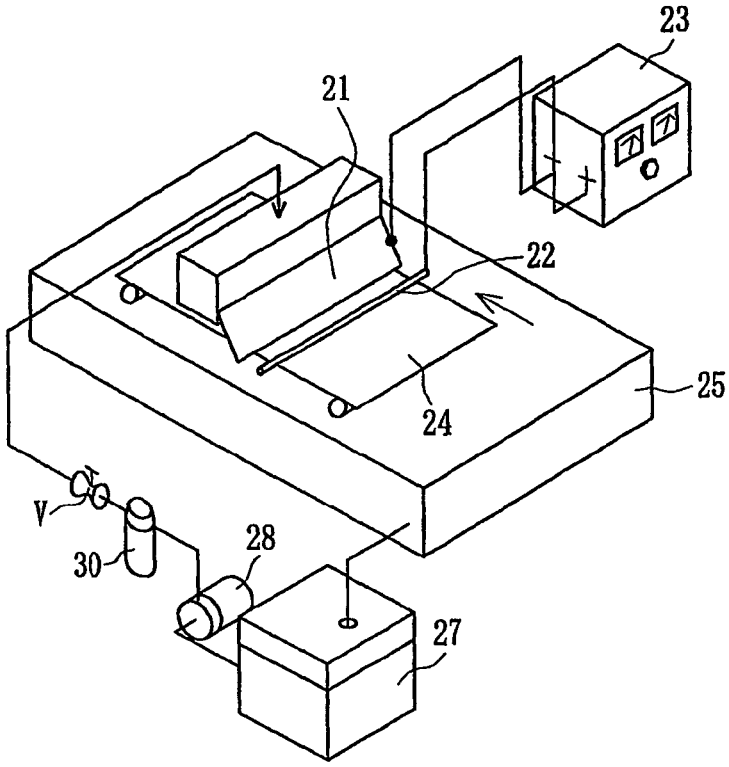
FIG. 3 is an overall structural diagram of FIG. 2.

First, FIGS. 1-3 illustrate one example of an apparatus for removing thin metal films as Embodiment 1 of the present invention.

In FIGS. 1-3, the symbol 21 indicates a metal-plate electrode that is of substantially the same width as that of the insulator 24 to be described later and that is disposed standing above electrolyte 26 in an inclined manner, 22 is an auxiliary electrode with its lower end immersed in the electrolyte 26, 23 is a DC voltage supply, 24 is an insulator that is immersed in an electrolyte (e.g., saline solution) 26 within a machining bath 25 and that has formed upon its surface a thin metal film 24*a* which is to be removed. Note that M indicates the electrolytic etching area and V indicates a valve.

In the example illustrated in FIG. 1, the electrolyte 26 within an electrolyte tank 27 is pumped by a pump 28 to the metal-plate electrode 21, and the auxiliary electrode 22 is cylindrical in shape and standing such that it is not in contact with the thin metal film 24*a* upon the surface of the insulator 24.

In the example illustrated in FIG. 2 and FIG. 3, the auxiliary electrode 22 may be formed in the shape of a roller that is free to rotate, for example, and that is disposed parallel to the metal-plate electrode 21, but this auxiliary electrode 22 is in contact with the thin metal film 24*a* on the surface of the insulator 24. Moreover, as shown in FIG. 3, the electrolyte 26 is recirculated and reused in such a manner that the used electrolyte 26 is recovered in the electrolyte tank 27 and then the recovered electrolyte 26 is passed through a filter 30 and pumped to the metal-plate electrode 21. Note that the roller-shaped auxiliary electrode 22 may also be disposed in a fixed manner so that it does not make contact with the thin metal film 24*a* on the surface of the insulator 24.

With Embodiment 1 of the present invention described above, the thin metal film 24*a* is removed in the following manner.

(1) The electrolyte 26 flows from the metal-plate electrode 21 toward the thin metal film 24*a*, thus forming an electrically continuous flow 26*a*.

(2) When a DC voltage is applied with the metal-plate electrode 21 as the cathode and the auxiliary electrode 22 as the anode, for example, a closed circuit is formed which consists of the DC voltage supply 23—metal-plate electrode 21—continuous flow 26*a*—thin metal film 24*a*—electrolyte 26—auxiliary electrode 22—DC voltage supply 23.

Figure 4:
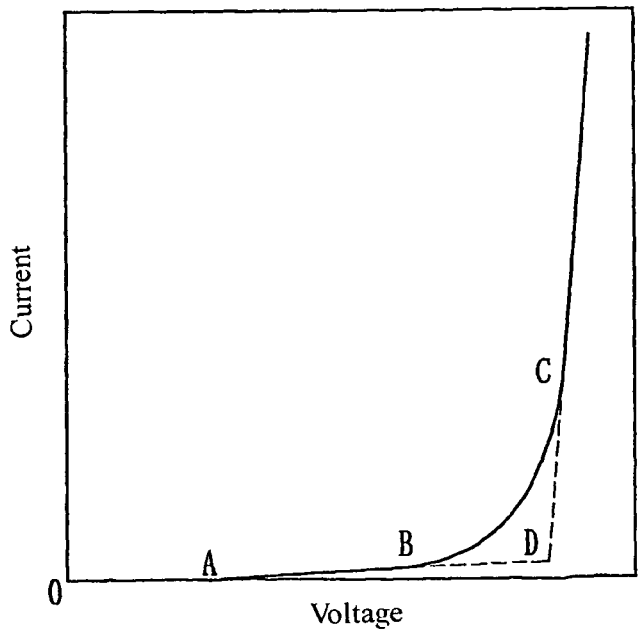
FIG. 4 is a diagram illustrating the relationship between voltage and current in the case that a closed circuit is formed by the DC voltage supply—metal-plate electrode—continuous flow—thin metal film—electrolyte within the machining bath—auxiliary electrode—DC voltage supply.

(3) When this circuit is formed, the relationship between voltage and current assumes a curve as shown in FIG. 4. In FIG. 4, when the applied voltage exceeds voltage A, hydrogen/oxygen ions and tiny bubbles begin to form on the surface of the metal-plate electrode 21 and thin metal film 24*a*. When the applied voltage exceeds voltage B, the current begins to rise rapidly and the amount of bubbles formed also increases rapidly.

(4) Furthermore, when the applied voltage exceeds voltage C, the voltage and current have a roughly proportional relationship, the Coulomb's law shown in Equation (1) below is nearly established and etching of the thin metal film is seen, so the work of removing the thin metal film 24*a* is performed. At this time, electrolytic etching of the insulator 24 naturally does not occur. Note that the voltage D is the minimum voltage for etching of metal, or namely the decomposition voltage, determined by the electrode material (surface activity), electrolyte concentration, line resistance and other factors.

$$W=\eta_1\cdot\eta_2\cdot k\cdot I\cdot t \quad (1)$$

Here, $\eta_1$: etching efficiency (%)

$\eta_2$: current efficiency (%)

k: electrochemical equivalent (mg/c)

I: electrolytic current (A)

t: electrolysis time (sec)

Embodiment 1 of the present invention (excluding the example illustrated in FIGS. 2 and 3) is a non-contact machining method, so the insulator will not be damaged. Moreover, there is no need for high precision in the control of the position between the electrode and the thin metal film. In addition, it is not chemical removal, but rather the work is done by electrolytic etching, so any electrolyte is usable as it conducts current, and thus $NaNO_3$, NaCl and other neutral salt electrolytes can be used. So the ease of work is superior and the disposal of waste electrolyte is simplified. Note that Embodiment 1 of the present invention as shown in FIGS. 2 and 3 is fundamentally identical to the above except that the only contact is with the roller-shaped auxiliary electrode 22.

Figure 5:
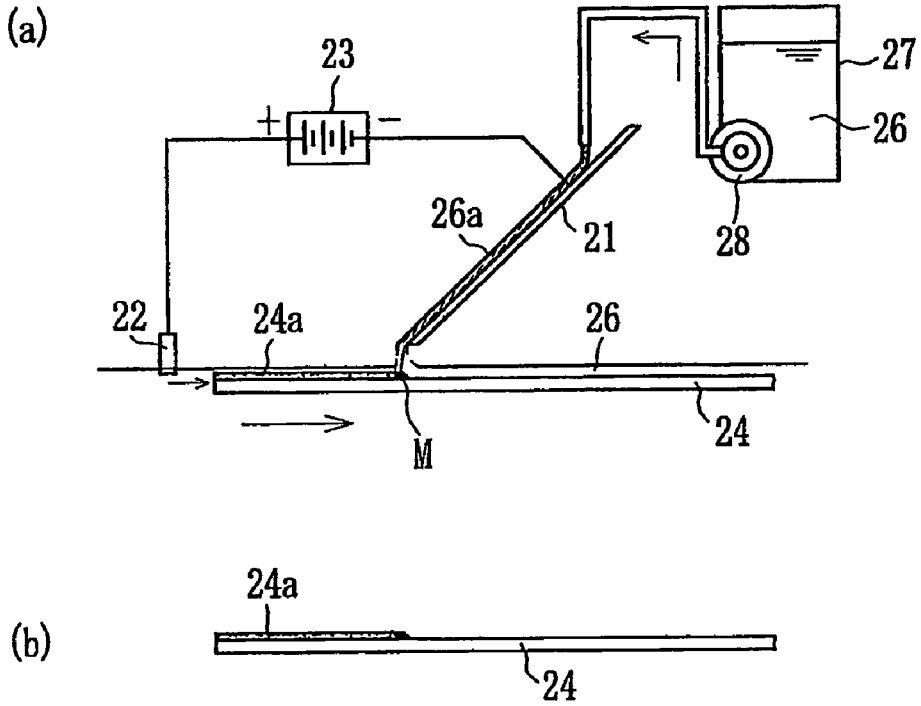
FIG. 5(*a*) is a diagram used to explain the reason why a thin metal film remains in the terminal area in Embodiment 1 of the present invention.

With Embodiment 1 of the present invention, as the insulator 24 is moved and the thin metal film 24*a* is removed, as it comes to the terminal end, as shown in FIG. 5(*a*), the thin metal film 24*a* becomes spatially separated from the auxiliary electrode 22, and thus the amount of current flowing in the thin metal film 24*a* decreases in comparison to that through the electrolyte 26. Accordingly, the current efficiency becomes poor, so the thin metal film 24*a* ultimately remains on the downstream-side (left side in the paper in FIG. 5) end.

Figure 6:
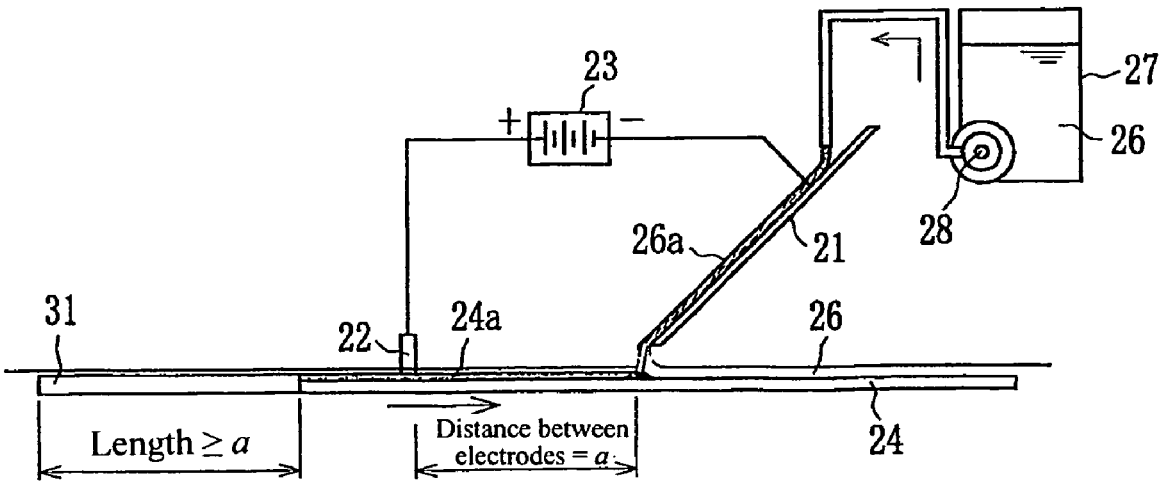
FIG. 6 is a diagram used to explain a method by which a thin metal film is not allowed to remain in the terminal area in Embodiment 1 of the present invention.

Accordingly, in Embodiment 1 of the present invention, as shown in FIG. 6, by placing a conductor plate 31 of roughly the same thickness as the insulator 24 at the downstream-side (left side in the paper in FIG. 5) end of the insulator 24, even after the terminal end of the insulator 24 passes by the auxiliary electrode 22, the closed circuit is formed which consists of the DC voltage supply 23—metal-plate electrode 21—continuous flow 26*a*—thin metal film 24*a*—conductor plate 31—electrolyte 26—auxiliary electrode 22—DC voltage supply 23, thus preventing any drop in the current efficiency. As a result, none of the thin metal film 24*a* remains at the downstream-side end. Note that in order to form the aforementioned closed circuit, the length of the conductor plate 31 in the direction of electrode motion is required to be longer than the gap a between the metal-plate electrode 21 and the auxiliary electrode 22.

Figure 7:
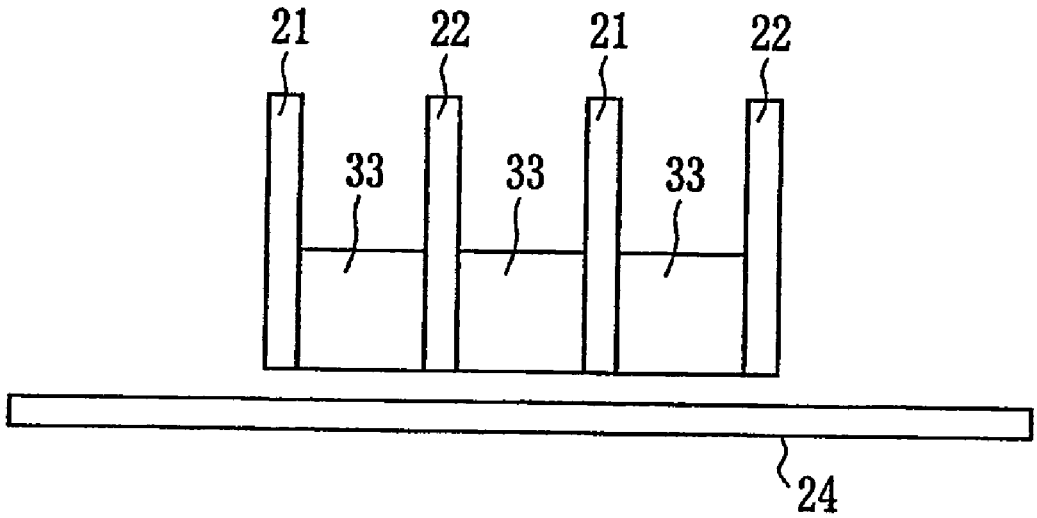
FIGS. 7(*a*) and (*b*) are other explanatory diagrams of modes by which a thin metal film is not allowed to remain in the terminal area in Embodiment 1 of the present invention.
Figure 7:
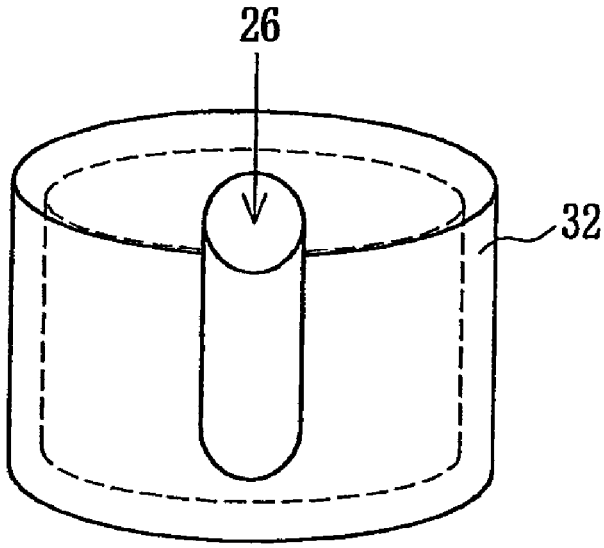

Instead of placing a conductor plate 31 of roughly the same thickness as the insulator 24 at the downstream-side end of the insulator 24 as shown in FIG. 6, the same function and meritorious effect as when placing a conductor plate 31 can be achieved by having the electrodes used for electrolytic etching consist of a plurality of cathodes (e.g., the metal-plate electrode 21) and anodes (e.g., the auxiliary electrode 22) disposed alternately as shown in FIG. 7(*a*), or by disposing a plurality of cylinders 32 with their insides as cathodes and their outsides as anodes as shown in FIG. 7(*b*).

Note that the one shown in FIG. 7(*a*) is one wherein the cathodes and electrodes are connected by insulators 33.

Figure 8:
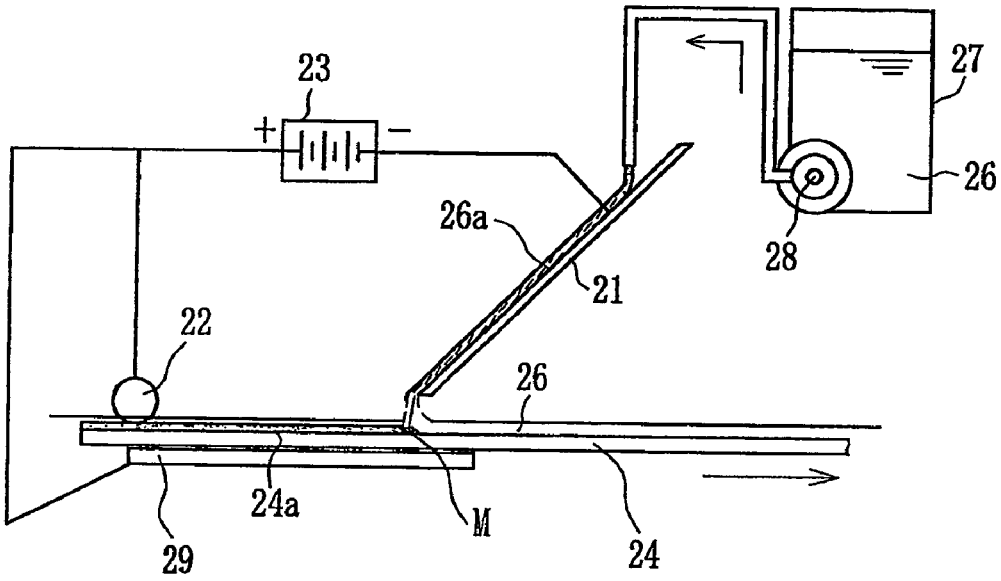
FIG. 8 is a schematic structural diagram illustrating one example of an apparatus for removing thin metal films as Embodiment 2 of the present invention.

Next, FIG. 8 illustrates one example of an apparatus for removing thin metal films as Embodiment 2 of the present invention. In FIG. 8, the symbol 29 indicates a bottom-surface electrode that is disposed below the metal-plate electrode 21 and auxiliary electrode 22 so as to span across these two electrodes 21 and 22, and the remainder of the constitution is the same as that illustrated in FIG. 3.

In Embodiments 1 and 2 of the present invention, the thin metal film directly below the anode portion is eluted, so as the etching proceeds. Therefore, the eluted metal increases the separation between the anode and thin film and may cause the current to cease to flow, stopping the etching process. If the surface area of the insulator 24 is large, it is not possible to remove the thin metal film 24*a* formed upon the entire surface.

To solve this problem, in Embodiments 1 and 2 of the present invention, if a movement mechanism that moves at least one of the insulator 24 and metal-plate electrode 21 immersed in the electrolyte relative to the other is provided, and the thin metal film 24*a* is removed while moving the insulator 24 and metal-plate electrode relative 21 to each other, then the thin metal film 24*a* can be removed over a wide range. In this case, in Embodiments 1 and 2 of the present invention, taking W (cm) to be the width of the metal-plate electrode 21, ν (cm/min) to be the relative movement speed, and I (A) to be the current, then it is preferable for the movement to occur at a relative movement speed indicated by the relationship:

$$0.1 \geqq I/(W\times\nu) \geqq 0.03.$$

When the metal-plate electrode 21 is to be moved with respect to the other, in Embodiments 1 and 2 of the present invention, it is preferable that the positively-charged auxiliary electrode 22 is positioned on the upstream side of the negatively-charged metal-plate electrode 21, or namely, the auxiliary electrode 22 is disposed such that it passes over the thin metal film 24*a* on the surface of the insulator 24 before the metal-plate electrode 21 does.

The reason for this is that since the positively-charged anode portion is eluted in electrolytic etching, the etching of the thin metal film 24*a* starts with that portion of the thin metal film 24*a* that is close to the negatively-charged cathode, or namely positioned below the metal-plate electrode 21 in the examples illustrated in FIGS. 1-3, FIG. 5 and FIG. 6, and FIG. 8, for example. To wit, were it to move in the opposite direction, the eluted portion of the thin metal film 24*a* would pass between the electrodes, so the closed circuit described previously would not be formed and continuous etching would become impossible. Note that in order to prevent etching of the anode, it is preferable that the anode electrode be carbon- or platinum-plated.

In Embodiments 1 and 2 of the present invention, when the metal-plate electrode 21 is moved relative to the insulator 24, if the auxiliary electrode 22 is fixed, then the voltage-current relationship varies as the distance between the electrodes changes with the movement of the metal-plate electrode 21. As a result, the thin metal film 24*a* may not be removed uniformly.

In such a case, this can be solved by disposing the auxiliary electrode 22 parallel to the metal-plate electrode 21 as shown in FIG. 2 or FIG. 3, for example, and moving both of them simultaneously.

In Embodiments 1 and 2 of the present invention, while the process of removing the thin metal film 24*a* is being conducted, if the electrolyte 26 should leak out and cover the insulator 24, then the electrolytic etching would start before the end of the insulator 24 passes by the metal-plate electrode 21 or auxiliary electrode 22. This occurs because while etching normally occurs only between the electrodes because the electric field (the strength of concentration of current) is strongest between the electrodes, concentration of the electric field may occur at the end of the insulator 24 immersed in electrolyte 26, thus giving an electric field strength equal to that between the electrodes.

Figure 9:
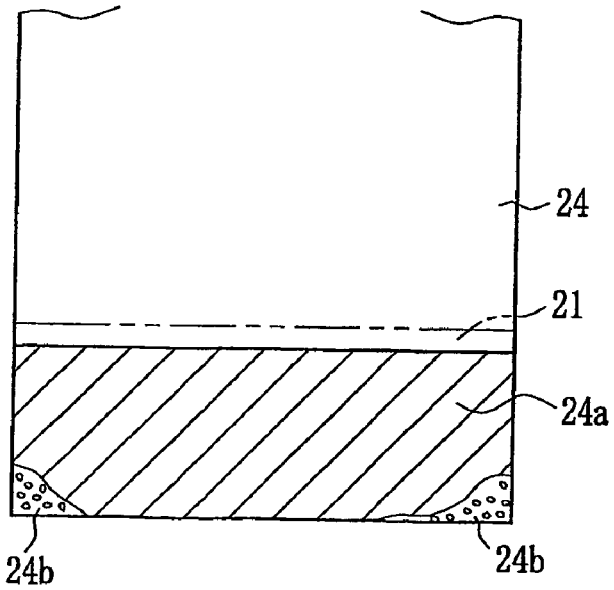
FIG. 9 a diagram used to explain the thin film of pitted metal remaining in the terminal area.

Moreover, the electric field is not uniform at the end of the insulator 24, so the removal of the thin metal film 24*a* may also not occur uniformly, and thus the thin metal film 24*a* may remain in a pitted manner as shown in FIG. 9. Note that 24*b* in FIG. 9 indicates the thin metal film 24*b* that remains in a pitted manner.

Even if the metal-plate electrode 21 is passed over the portion where such a pitted thin metal film 24*b* remains, the continuity of the thin metal film is disrupted so the closed circuit described previously is not formed and the thin metal film 24*b* is not removed but remains.

Figure 10:
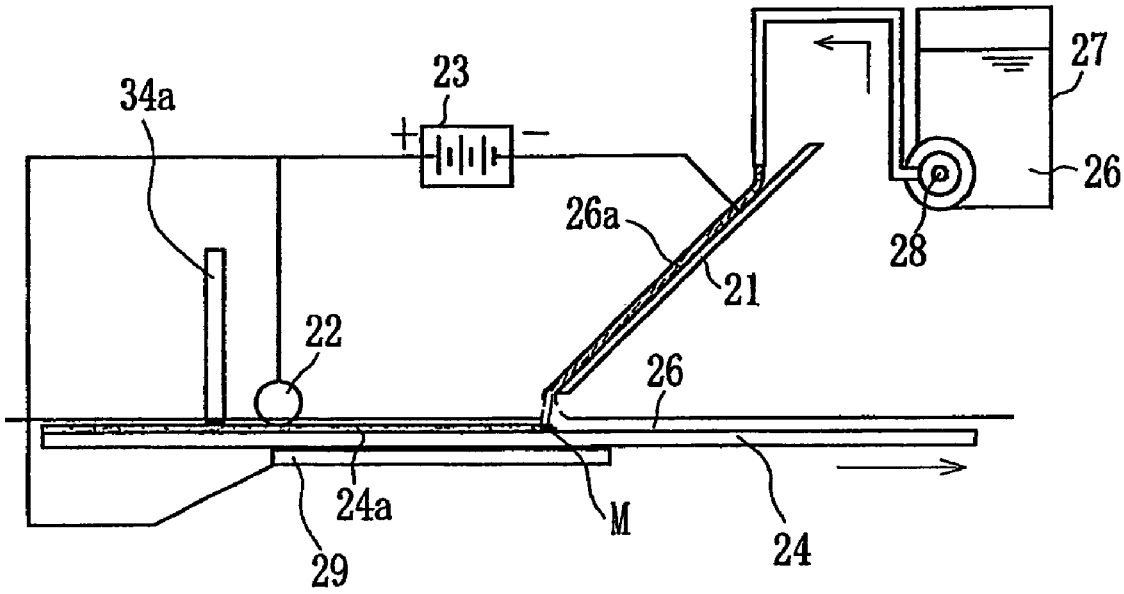
FIG. 10 is a schematic structural diagram illustrating one example of an apparatus for removing thin metal films as Embodiment 3 of the present invention.
Figure 11:
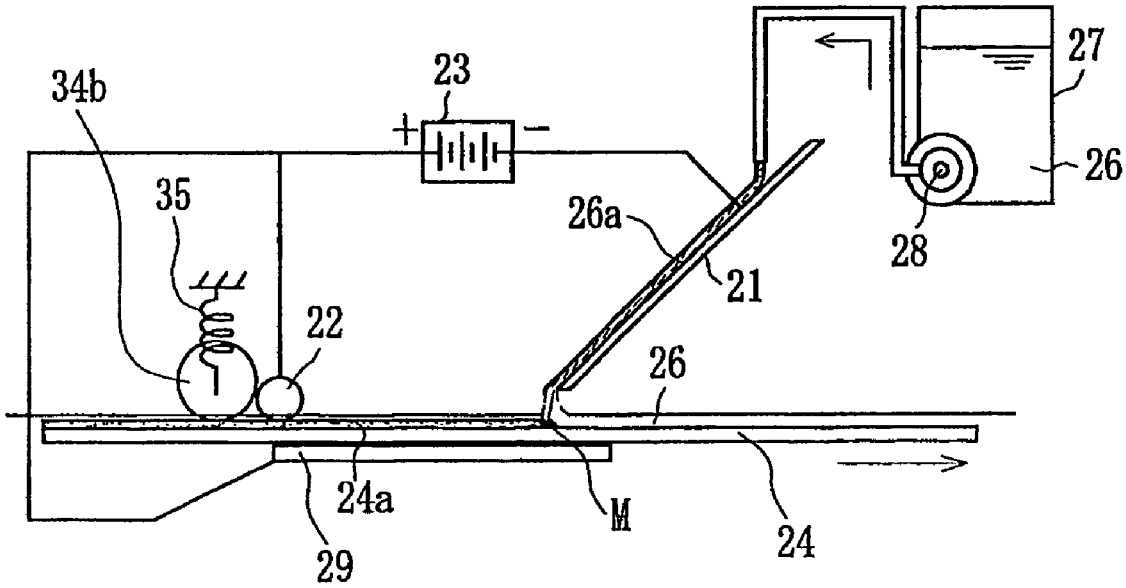
FIG. 11 is a schematic structural diagram illustrating another example of an apparatus for removing thin metal films as Embodiment 3 of the present invention.

Accordingly, in Embodiments 1 and 2 of the present invention, by placing a member that suppresses the intrusion of electrolyte 26 on the advancing side of the insulator 24 at the metal-plate electrode 21, for example, a rubber wall 34*a* with substantially the same width as that of the insulator 24 in as close of contact with the surface of the insulator 24 as possible as shown in FIG. 10, or by placing a rubber roller 34*b* with substantially the same width as that of the insulator 24 such that it is pressed against the surface side of the insulator 24 by a spring 35 as shown in FIG. 11, it is possible to suppress the early intrusion of electrolyte 26 toward the side of the end of the insulator 24, thus preventing the occurrence of the pitted thin metal film 24*b*. This is Embodiment 3 of the present invention.

In addition, in Embodiments 1-3 of the present invention, current flows via the electrolyte 26, so the current flowing through the electrolyte 26 causes deterioration of the efficiency of etching of the thin metal film 24*a*.

Figure 12:
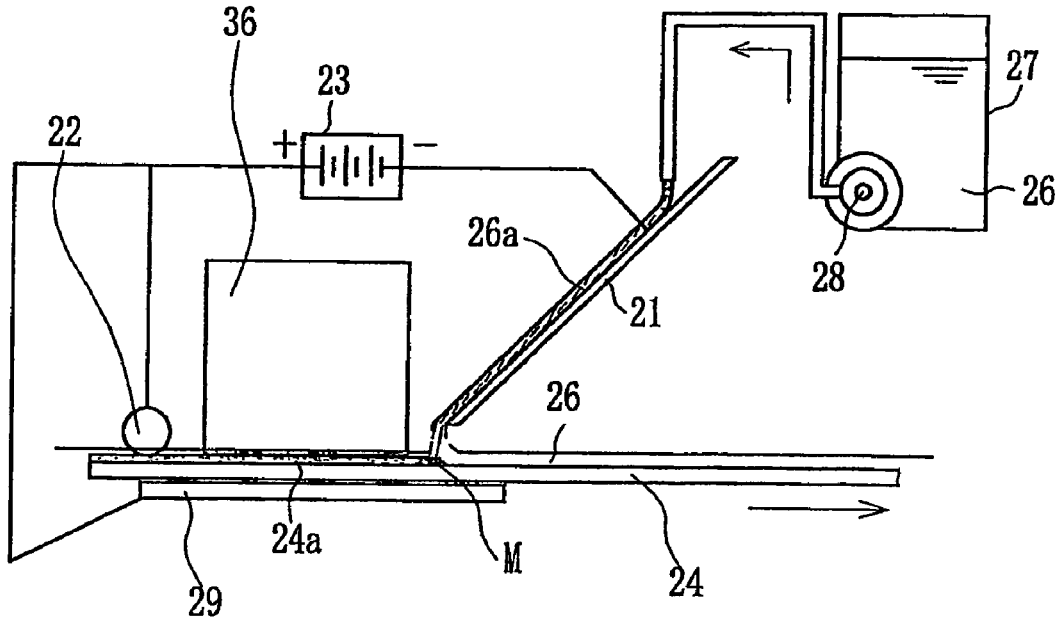
FIG. 12 is a schematic structural diagram illustrating another example of an apparatus for removing thin metal films as another variation of Embodiment 3 of the present invention.

Accordingly, in Embodiments 1-3 of the present invention, if an insulator wall 36 with substantially the same width as that of the insulator 24 is disposed in as close of contact with the surface of the insulator 24 as possible between the metal-plate electrode 21 and auxiliary electrode 22 on the surface side of the insulator 24, as shown in FIG. 12, the current flowing through the electrolyte 26 will be decreased and the efficiency of etching of the thin metal film 24*a* will be improved.

In addition, while Embodiments 1-3 of the present invention are able to remove the thin metal film 24*a* efficiently without damaging the insulator 24, the current flowing through the electrolyte 26 removes the thin metal film 24*a* by eluting the thin metal film 24*a*, so there are cases in which a residue of film from electrolytic etching remains.

Accordingly, in Embodiments 1-3 of the present invention, the metal-plate electrode 21 is replaced with a rotatable electrode 37 and also abrasive material is disposed in the area where this rotatable electrode 37 makes contact with the thin metal film 24*a*, or means of supplying abrasive material to the area of contact between this electrode 37 and the thin metal film 24*a* is provided. With such a constitution, the abrasive material positioned in the area of contact between this electrode 37 and the thin metal film abrades the surface of the thin metal film 24*a*, so any residual film left from electrolytic etching is completely removed. This is Embodiment 4 of the present invention.

Figure 13:
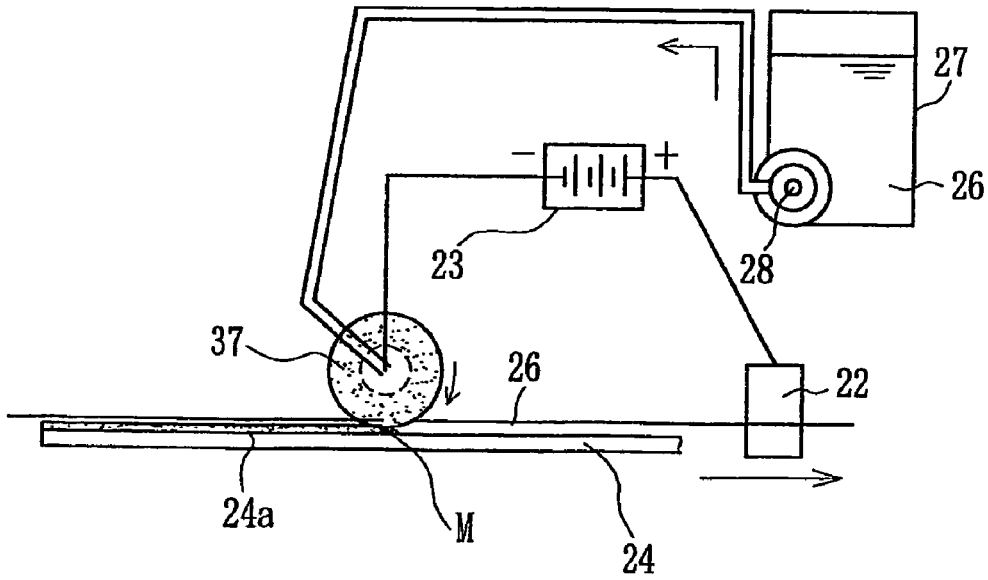
FIG. 13 is a schematic structural diagram illustrating one example of an apparatus for removing thin metal films as Embodiment 4 of the present invention.
Figure 14:
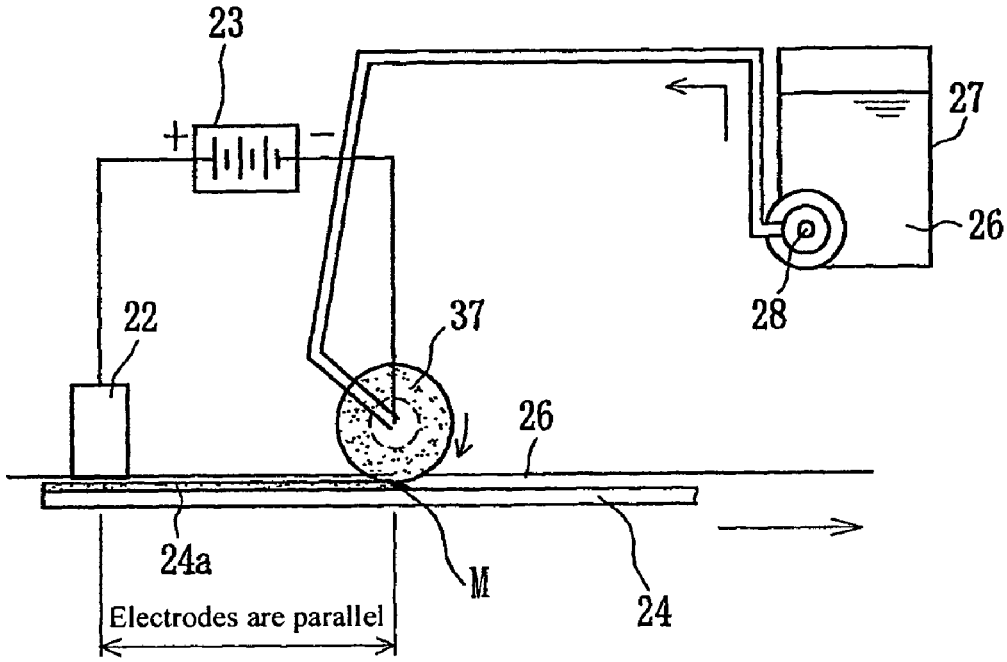
FIG. 14 is a schematic structural diagram illustrating a second example of an apparatus for removing thin metal films as Embodiment 4 of the present invention.
Figure 15:
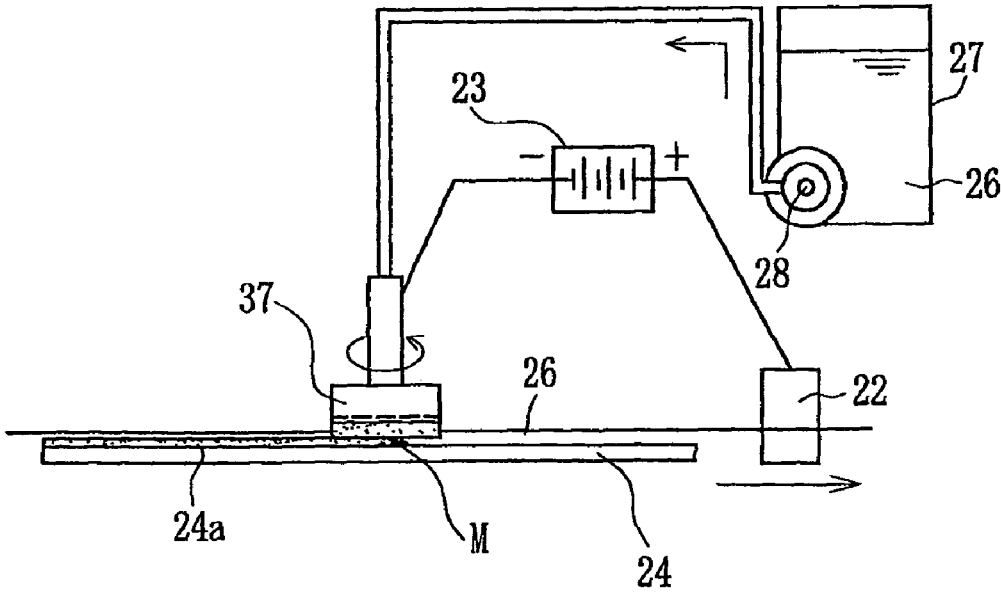
FIG. 15 is a schematic structural diagram illustrating a third example of an apparatus for removing thin metal films as Embodiment 4 of the present invention.
Figure 16:
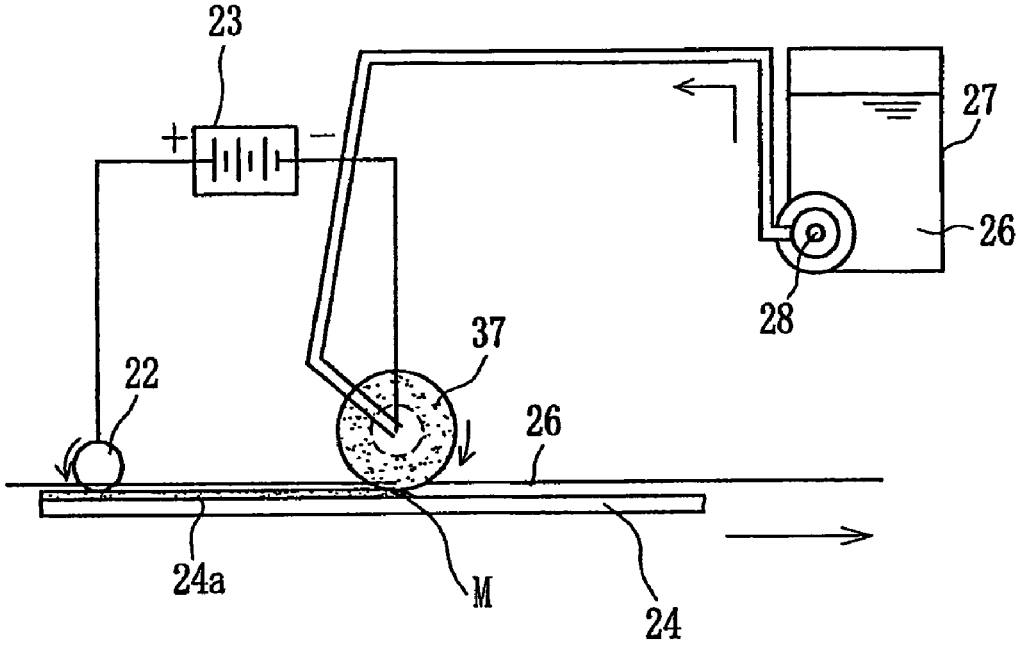
FIG. 16 is a schematic structural diagram illustrating a fourth example of an apparatus for removing thin metal films as Embodiment 4 of the present invention.
Figure 17:
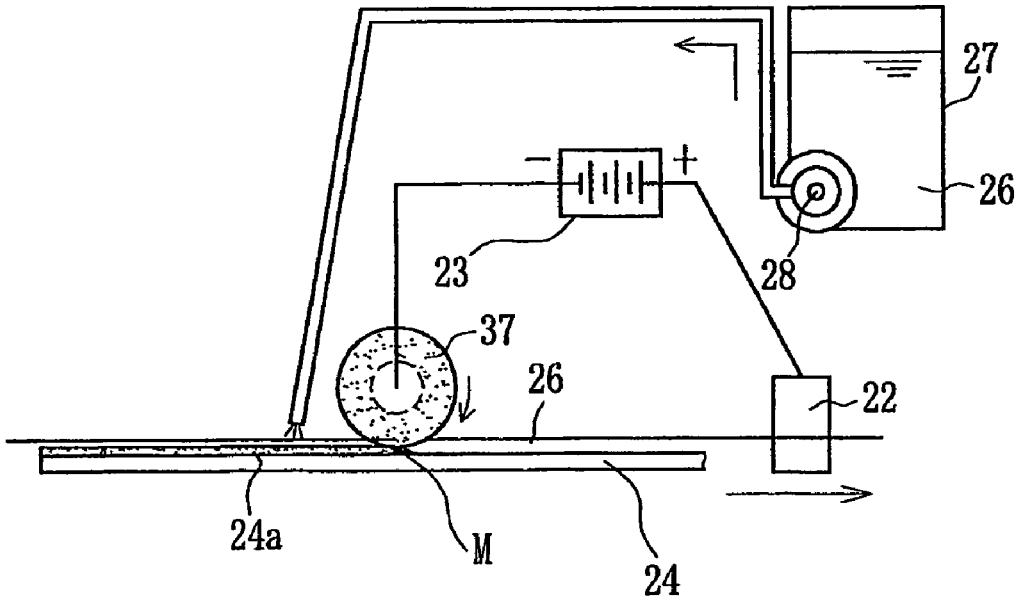
FIG. 17 is a schematic structural diagram illustrating a fifth example of an apparatus for removing thin metal films as Embodiment 4 of the present invention.
Figure 18:
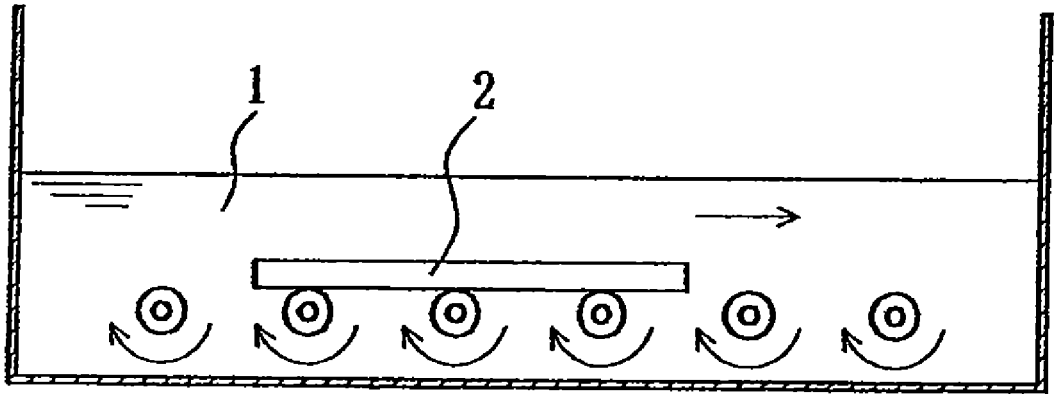
PRIOR ART FIG. 18
FIG. 18 is a diagram used to describe the method for removing thin metal films by chemical etching.

The example shown in FIG. 13, for example, is one wherein electrolyte 26 from the electrolyte tank 27 is supplied to the center of a rotatable rod-shaped electrode 37 with water-permeable abrasive material disposed on its periphery, so electrolyte 26 flows out from the periphery of the rod-shaped electrode 37. The example shown in FIG. 14 is one wherein the auxiliary electrode 22 of the example shown in FIG. 13 is disposed parallel to the rod-shaped electrode 37. The example shown in FIG. 15 is one wherein the rod-shaped electrode 37 of the example shown in FIG. 13 is replaced with a rotatable disk-shaped electrode 37 with water-permeable abrasive material disposed on its bottom surface. The example shown in FIG. 16 is one wherein the auxiliary electrode 22 shown in FIG. 14 is formed in the shape of a roller and put in contact with the thin metal film 24*a* on the surface of the insulator 24. The example shown in FIG. 17 is one wherein the electrolyte 26 is supplied not to the interior of the electrode 37 but from outside.

The examples given above are ones wherein abrasive material is disposed in the area of contact between the electrode 37 and the thin metal film 24*a*, but rather than having abrasive material disposed at the electrode 37, abrasive material may be supplied to the area of contact between this electrode 37 and the thin metal film 24*a*.

Here follows a description of the results of experiments performed in order to confirm the meritorious effects of the present invention.

A. Embodiment 1 of the Present Invention (Experiment 1)

When the first apparatus for removing thin metal films according to the present invention with the constitution shown in FIG. 3 (width of the metal-plate electrode: 1000 mm) was used to implement the first method for removing thin metal films according to the present invention under the machining conditions given below, a $1000\times10^{-10}$ m-thick thin aluminum film that was vapor-deposited upon a 1000 mm×1000 mm glass substrate was removed efficiently so that the glass substrate could be reused. In addition, when the second method for removing thin metal films according to the present invention was implemented with a roller-shaped auxiliary electrode disposed in a fixed manner such that it was not in contact with the glass substrate, under the same machining conditions except that the current was changed to 300 A, the thin aluminum film vapor-deposited upon the glass substrate was similarly removed efficiently so that the glass substrate could be reused.

[Machining Conditions]
Electrolyte: 20% NaCl
Flow rate: ~30 liters/min
Applied voltage: ~100 V
Current: 150 A
Glass substrate movement speed: 1 m/min B. Embodiment 1 of the Present Invention (Experiment 2)

When the first apparatus for removing thin metal films according to the present invention with the constitution shown in FIG. 3 was used to implement the first method for removing thin metal films according to the present invention, with a carbon plate of the same thickness as a 1000 mm×1000 mm glass substrate (thickness: 0.7 mm) disposed at the terminal end of the plate as shown in FIG. 6, under the machining conditions given below, a $1000\times10^{-10}$ m-thick thin aluminum film that was vapor-deposited upon the glass substrate was removed efficiently so that the glass substrate could be reused.

[Machining Conditions]
Electrolyte: 5% NaCl
Flow rate: ~30 liters/min
Applied voltage: ~100 V Current: 300 A
Glass substrate movement speed: 1 m/min C. Embodiment 3 of the Present Invention (Experiment 1)

When the third apparatus for removing thin metal films according to the present invention with the constitution shown in FIG. 10 was used to implement the third method for removing thin metal films according to the present invention under the machining conditions given below, a $1000\times10^{-10}$ m-thick thin aluminum film that was vapor-deposited upon a 1000 mm×1000 mm glass substrate (thickness: 0.7 mm) was removed completely up to the terminal end so that the glass substrate could be reused.

[Machining Conditions]
Electrolyte: 5% NaCl
Flow rate: ~30 liters/min
Applied voltage: ~100 V
Current: 300 A
Glass substrate movement speed: 1 m/min
Intrusion-suppressing member: Rubber wall D. Embodiment 3 of the Present Invention (Experiment 2)

When the third apparatus for removing thin metal films according to the present invention with the constitution shown in FIG. 12 was used to implement the third method for removing thin metal films according to the present invention under the machining conditions given below, a 1000×10−10 m-thick thin aluminum film that was vapor-deposited upon a 1000 mm×1000 mm glass substrate (thickness: 0.7 mm) was removed efficiently even though the movement speed was increased by 10% above that of the other embodiments so that the glass substrate could be reused.

[Machining Conditions]
Electrolyte: 5% NaCl
Flow rate: ~30 liters/min
Applied voltage: ~100 V
Current: 300 A
Glass substrate movement speed: 1.1 m/min
Intrusion-suppressing member: PVC wall E. Embodiment 4 of the Present Invention When the fourth apparatus for removing thin metal films according to the present invention with the constitution shown in FIG. 16 was used to implement the fourth method for removing thin metal films according to the present invention under the machining conditions given below, a 1000×10−10 m-thick thin aluminum film that was vapor-deposited upon a 1000 mm×1000 mm glass substrate was removed completely with no residue remaining so that the glass substrate could be reused.

[Machining Conditions]
Electrolyte: 20% NaCl
Flow rate: ~30 liters/min
Speed of rotation of the rod-shaped electrode: 600 rpm
Abrasive grit: #300 alumina grit (supplied mixed in electrolyte)
Applied voltage: ~100 V
Current: 200 A
Glass substrate movement speed: 1 m/min The aforementioned embodiments do not correspond to all of the Claims of the present invention, but even with those Claims for which an embodiment is not presented, the thin metal films formed upon the insulator were of course removed efficiently and the insulator could be reused.

INDUSTRIAL USABILITY

As described above, with the present invention, without using strongly acidic or strongly alkaline chemical solutions, and without requiring precision control of the position of an electrode with respect to a thin metal film on an insulator surface, the thin metal film can be removed efficiently in a non-contact manner without damaging the insulator, and expensive high-performance glass substrates used in the semiconductor field can be reused.

The invention claimed is:

1. A method for removing a thin metal film from an insulative material, comprising:

disposing an auxiliary electrode across a width of the thin metal film to be removed in such a manner that at least a part of the auxiliary electrode is immersed in an electrolyte in a reservoir;

disposing a metal-plate electrode at a distance from the auxiliary electrode at an angle inclined towards the auxiliary electrode, the metal-plate electrode having a width at least as wide as the thin metal film to be removed;

flowing a layer of the electrolyte down into the reservoir along an inclined surface of the metal-plate electrode, the layer of the electrolyte having a width at least as wide as the thin metal film to be removed;

applying a DC voltage between the metal-plate electrode and the auxiliary electrode; and removing the thin metal film from the insulative material in the reservoir while flowing the electrolyte down from the metal-plate electrode against the thin metal film on the insulative material.

2. A method according to claim 1, further comprising disposing a bottom-surface electrode on a back side of the insulative material and applying a DC voltage of the same polarity as that of the auxiliary electrode to the bottom-surface electrode.

3. A method according to claim 1, wherein removing the thin metal film from the insulative material in the reservoir comprises moving the insulative material relative to the metal-plate electrode.

4. A method according to claims 1, further comprising providing a member that impedes an early contact of the thin metal film with the electrolyte.

5. An apparatus for removing a thin metal film from an insulative material, comprising:

an auxiliary electrode disposed across a width of the thin metal film to be removed in such a manner that at least a part of the auxiliary electrode is immersed in an electrolyte in a reservoir;

a metal-plate electrode disposed at a distance from the auxiliary electrode at an angle inclined towards the auxiliary electrode, the metal-plate electrode having a width at least as wide as the thin metal film to be removed;

an electrolyte supply that flows a layer of the electrolyte down into the reservoir along an inclined surface of the metal-plate electrode, the layer of the electrolyte having a width at least as wide as the thin metal film to be removed; and a DC voltage supply that applies a DC voltage to the metal-plate electrode and the auxiliary electrode in order to remove the thin metal film from the insulative material in the reservoir while flowing the electrolyte down from the metal-plate electrode against the thin metal film on the insulative material.

6. An apparatus according to claim 5 further comprising a bottom-surface electrode disposed on a back side of the insulative material, wherein the DC voltage supply applies a DC voltage of the same polarity as that of the auxiliary electrode to the bottom-surface electrode.

7. An apparatus according to claim 5 further comprising a movement mechanism that moves the insulative material relative to the metal-plate electrode.

8. An apparatus according to claims 5 further comprising a member that impedes an early contact of the thin metal film with the electrolyte.

9. A method according to claim 3, further providing a conductive plate at a trailing edge of the insulative material moving relatively towards the metal-plate electrode to maintain an electrical connection between the auxiliary electrode and the thin metal film on the insulative material.

10. An apparatus according to claim 7, further comprising a conductive plate disposed at a trailing edge of the insulative material moving relatively towards the metal-plate electrode in order to maintain an electrical connection between the auxiliary electrode and the thin metal film on the insulative material.

* * * * *

UNITED STATES PATENT AND TRADEMARK OFFICE

CERTIFICATE OF CORRECTION

PATENT NO. : 7,544,283 B2
APPLICATION NO. : 11/103182
DATED : June 9, 2009
INVENTOR(S) : Hiroyuki Daiku et al.

It is certified that error appears in the above-identified patent and that said Letters Patent is hereby corrected as shown below:

In column 10, claim 4, line 47, after "method according to" delete "claims" and substitute --claim-- in its place.

In column 11, claim 8, line 12, after "apparatus according to" delete "claims" and substitute --claim-- in its place.

Signed and Sealed this

Eighteenth Day of August, 2009

David J. Kappos

David J. Kappos
*Director of the United States Patent and Trademark Office*